US006082994A

United States Patent [19]

Grandveau et al.

[11] Patent Number: 6,082,994

[45] Date of Patent: Jul. 4, 2000

[54] GAS BURNER FOR COOKING APPARATUS

[75] Inventors: Gilles Grandveau, Taverny; Alain Meslif, Saint-Martin-Du-Tertre, both of France

[73] Assignee: Gaz de France, Paris, France

[21] Appl. No.: 09/277,186

[22] Filed: Mar. 26, 1999

[30] Foreign Application Priority Data

Mar. 26, 1998 [FR] France ..... 98 03 771

[51] Int. Cl.[7] ..... F23D 14/06; F23D 14/58

[52] U.S. Cl. ..... 431/349; 431/354; 239/552; 239/555; 239/567; 239/568

[58] Field of Search ..... 431/326, 328, 431/354, 266, 286; 126/39 K, 39 R, 39 E, 39 H; 239/552, 555, 554, 567, 553.5, 568

[56] References Cited

U.S. PATENT DOCUMENTS

| | | | |
|---|---|---|---|
| 3,820,945 | 6/1974 | Vignes | 431/349 |
| 5,040,970 | 8/1991 | Riehl | 431/264 |
| 5,899,681 | 5/1999 | Maughan | 431/349 |

FOREIGN PATENT DOCUMENTS

| | | | |
|---|---|---|---|
| 303 312 | 11/1972 | Austria . | |
| 0 534 302 | 3/1993 | European Pat. Off. . | |
| 1304720 | 10/1962 | France | 431/349 |
| 1 327 885 | 9/1963 | France . | |
| 2161354 | 7/1973 | France . | |
| 2305691 | 10/1976 | France | 431/354 |
| 2 726 632 | 5/1996 | France . | |
| 819314 | 9/1949 | Germany | 239/567 |
| 1 950 506 | 4/1971 | Germany . | |
| 2 224 824 | 5/1960 | United Kingdom . | |
| 975426 | 11/1964 | United Kingdom | 431/349 |
| 2 256 268 | 12/1992 | United Kingdom . | |

*Primary Examiner*—Carl D. Price
*Attorney, Agent, or Firm*—Leydig, Voit & Mayer

[57] ABSTRACT

A gas burner for a cooking apparatus including a head and a cap to be laid upon the head is disclosed. The head includes a base formed with a through-aperture for feeding an air/gas mixture and a peripheral skirt formed with slits substantially perpendicular to the plane of the base. The burner has a plurality of protrusions on the top face of the skirt, each one of the protrusions being at equal distance between two adjacent slits and located at least in part in the inner half of the top face of the skirt.

11 Claims, 2 Drawing Sheets

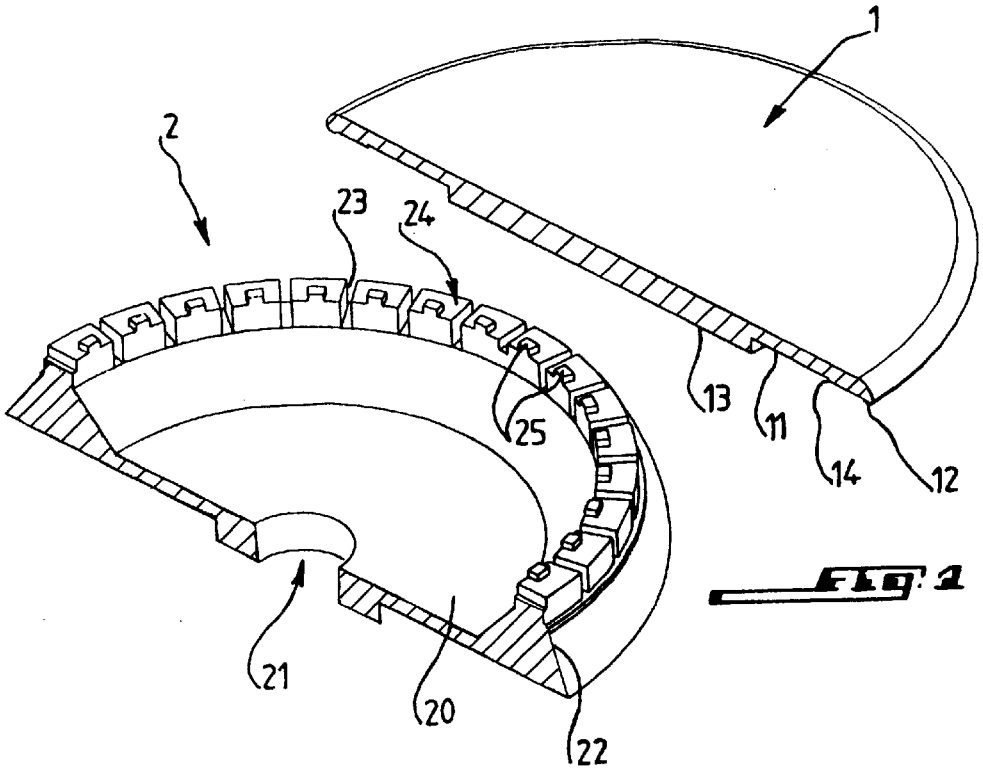
FIG. 1
FIG. 2
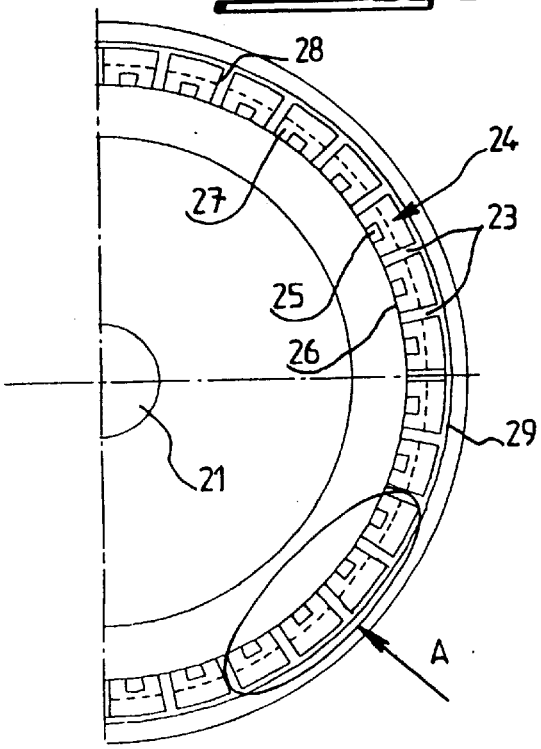
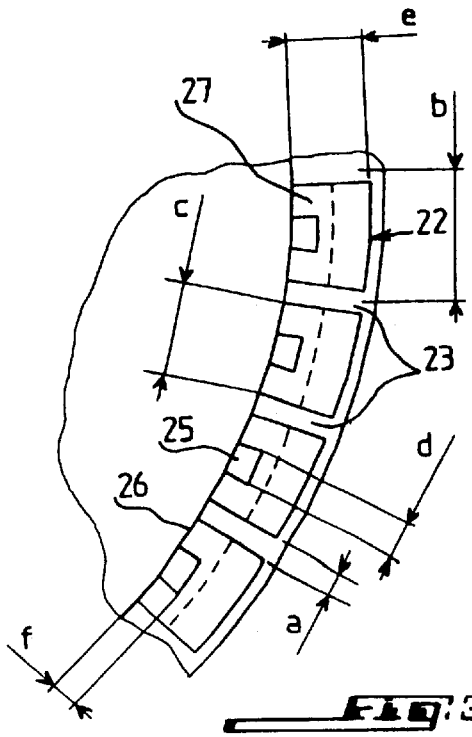
FIG. 3

GAS BURNER FOR COOKING APPARATUS

FIELD OF THE INVENTION

The invention relates to a gas burner for a cooking apparatus. Such a burner is formed with outlet apertures for an air/gas mixture at which flames may appear.

BACKGROUND

In a general manner the burners are conceived and designed so that they may operate irrespective of the feed gas: town or city gas, natural gas or liquefied petroleum gas.

The flames which appear at the outlet holes for the gas/air mixture should remain stable, even in case of variation of the characteristic features of the air/gas mixture.

Several solutions have already been proposed for providing multiple gas burners.

There may at first be cited the burners with a so-called "stabilization by a pilot flame". These burners comprise a cap or cover, the edge or flange of which is perforated with holes, and which is resting upon a support.

The main flames which appear at these holes are stabilized by a small flame generated at the base of and possibly above the main flames. This pilot flame permits re-heating of the air/gas mixture of the main flame and permanently ignites the main flame again.

This solution has now a tendency to be abandoned because the manufacturing cost of the burner is high.

Furthermore this burner may not operate with low gas powers. In this case indeed, the pilot flame has a tendency to extinguish or to become quenched and the main flames then become sensitive to drafts or like air currents. Finally, at a high power of the pilot flame, the burner produces CO.

Other so-called "self-stabilized" burners provide stabilization of the flames owing to a particular shape of the outlet section for the air/gas mixture.

An example of a burner of this kind comprises a cap or cover having a peripheral flange or edge with which the cap rests upon a support. Slits are formed in this flange or edge for the exit of the air/gas mixture.

These slits are narrow and their walls have a trapezoidal profile. Thus to the portion of each slit exhibiting a great thickness corresponds a low egress speed of the mixture, which permits a retaining of the flames, whereas the portion of the slit having a small thickness corresponds a substantial mixture flow rate.

This solution has known a great success but it has gradually been abandoned since it is not adapted to the new techniques using aluminum injection molding.

It is indeed the cap which comprises the outlet holes for the air/gas mixture and it should moreover be made from a material withstanding high temperatures, which is not the case of aluminum.

Another example of a burner of this type is provided in two parts, namely an enamelled cast iron or steel cap which is laid upon a head made from injection molded aluminum.

The head comprises a base which supports a peripheral skirt. It is in this skirt where the outlet apertures for the air/gas mixture are formed.

These apertures are constituted by shallower and deeper slits arranged in alternating relationship. The cap rests directly upon the skirt of the burner head.

The shallow slits throttle the air/gas mixture and produce flames which are shorter than the main flames exiting from the deeper slits. These main flames thus are stabilized.

It could be found that with this kind of burner, the gas did not ignite directly at the contact with the burner head. Since these burners are sensitive to the blow-off of the flames, the air proportion in the air/gas mixture should be limited. Owing to this smaller aeration with primary air, these burners require good secondary aeration.

For that purpose the main slits should be spaced widely and the diameter of the burner head therefore is relatively large. Furthermore it is necessary to provide a relatively large height underneath the grate for promoting the secondary aeration.

SUMMARY OF THE INVENTION

The object of the present invention is to cope with the inconveniences of the known burners by providing a gas burner adapted to different combustion gases, of which the manufacturing cost is reduced and which is compatible with mass production and may be used with a reduced height below the grid and in a broad range of gas powers.

Thus the invention relates to a gas burner for cooking apparatus comprising a head and a cap intended to be laid upon the head, the head comprising a base perforated with an aperture for the feed with an air/gas mixture and supporting a peripheral skirt with slits substantially perpendicular to the plane of the base, and a plurality of protrusions on the upper face of the skirt, each one of the slits being substantially equidistant between two adjacent slits and located at least in part in the inner half of the upper face of the said skirt, the protrusions thus forming a space between the cap and the head in which one portion of the air/gas mixture is throttled.

Preferably the width of the protrusions is smaller than one half of the thickness or land between two adjacent slits.

Likewise, preferably, the depth of the protrusions is smaller than one half of the depth of the slits or also of the thickness of the peripheral skirt.

In a preferred embodiment, each protrusion comprises one side located in the plane of the inner edge of the skirt.

In an advantageous manner, the cap of the burner slightly projects edgewise and comprises, on the periphery of its inner face, a nose-like flange turned towards the head.

Advantageously the cap also comprises a boss which is substantially centered on its inner face.

The invention also relates to a gas burner for a cooking top or hotplate.

In this case, the aperture formed in the base of the burner head permits the supply with gas from an injector and the base exhibits a suitable shape for providing an air/gas mixture with the cap of the burner.

According to the invention, the cap comprises, as a hollow or sunk formation in its inner face, having a concavity turned towards the burner head.

Preferably this dome forms a portion of a spherical surface of which the center is located on the injector and of which the radius corresponds to the distance between the dome and the injector.

Preferably the head and the cap have a substantially circular or oval shape.

The burner head is advantageously made through injection molding of aluminum whereas the cap is obtained through molding or shaping cast iron or steel.

BRIEF DESCRIPTION OF DRAWING FIGURES

The invention will be better understood and further objects, characterizing features, details and advantages thereof will appear more clearly as the following explanatory description proceeds with reference to the attached diagrammatic drawings given by way of non limiting examples only illustrating several embodiments of the invention and in which:

FIG. 1 is an exploded perspective view with parts broken away of a burner according to the invention;

FIG. 2 is a half top view of the burner head according to the invention;

FIG. 3 is an enlarged view of the detail A of FIG. 2;

The elements common to the different figures will be designated with the same reference characters.

DETAILED DESCRIPTION

Figure 4:
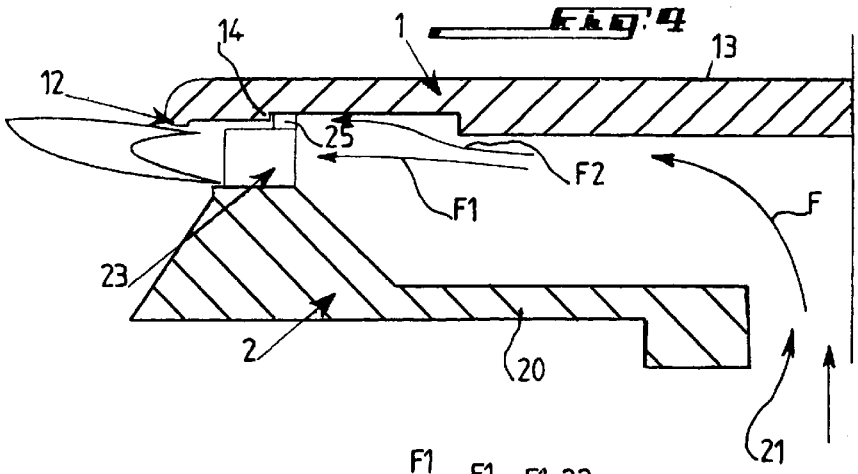
FIG. 4 is a half view in axial section of the burner according to the invention with a main flame corresponding to a substantial air/gas mixture flow rate.

Reference should at first be had to FIG. 1 which partially illustrates both component elements of the gas burner according to the invention, namely the cap 1 and the head 2 which both have a general circular shape. The invention is not limited to this particular shape and the cap and the head may also have an oval shape.

The cap 1 comprises at the periphery of its inner face 11, a nose-like flange 12 the function of which will be described subsequently.

The cap also comprises a boss 13 on its internal face 11 and which is substantially centered. The function of this boss and that of the ledge or shoulder 14 provided between the boss 13 and the flange 12 will also be described in the following description.

The head 2 of the burner comprises a base 20 which is perforated with an opening 21 for feeding an air/gas mixture. The base 20 is substantially flat.

The gas is coming from an injector which is not shown on FIG. 1.

The base 20 includes a peripheral skirt 22, the outer periphery of which is bent or curved towards the center of the base.

In this peripheral skirt 22 are formed slits 23 which are substantially perpendicular to the plane of the base 20. These slits extend over a portion of the height of the skirt 22 and are relatively narrow.

On the top face 24 of the skirt 22 are provided protrusions 25.

As also shown in FIGS. 2 and 3, one protrusion 25 is provided between two adjacent slits 23.

The protrusion 25 is preferably substantially centered or at an equal distance between adjacent slits 23.

Moreover, the protrusion 25 is located at the inner edge 26 of the skirt 22. Thus the protrusion 25 is located, at least in part, in the inner half 27 of the top face 24 of the skirt 22 as defined by the lines in dashes on FIG. 2.

Preferably the protrusions 25 are completely located in this inner half 27 and in particular have one side located in the plane of the inner edge 26 of the skirt 22 as shown in FIGS. 1 and 2.

Reference will now be made to FIG. 3 for giving preferred dimensions of the protrusions 25.

Thus the depth f of the protrusions preferably is smaller than one half of the depth e of the main slits 23 or smaller than one half of the thickness of the skirt 22. Under these conditions, the protrusions 25 may be fully located on the inner half 27 of the upper face 24 of the skirt 22.

Furthermore the width d of the protrusions 25 preferably is smaller than one half of the thickness c of the skirt 22 between two adjacent slits 23.

Reference should now be had to FIG. 4 which shows that the presence of the protrusions 25 forms a space between the burner head 2 and the cap of the burner 1.

FIG. 4 shows that the step or shoulder 14 formed on the internal face of the cap 1 permits positioning of the cap on the head of the burner in a relatively stable manner.

The operation of the burner according to the invention will now be explained with reference to FIGS. 4 to 6.

An air/gas mixture produced by a mixer not shown in the figures arrives in the space between the head and the cap of the burner through the opening 21 formed in the base 20. The corresponding flow is shown by the arrow F.

This flow of gas/air mixture then moves towards the outlet apertures constituted by the slits 23 and the space provided between the protrusions 25.

The greatest part of the gas/air mixture shown by the arrow F1 flows out through the slits 23. It is at the level of these slits that the main flames would appear.

A fraction of the gas/air mixture shown by the arrow F2 flows into the space between the protrusions 25 and the upper face 24 of the skirt and the bottom face 11 of the cap.

Figure 5:
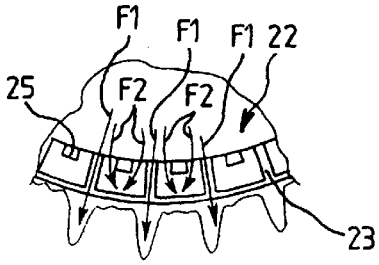
FIG. 5 is a partial top view of the burner head according to the invention showing the flow of the air/gas mixture.

This flow of the air/gas mixture in the slits 23 and in that space is also shown on FIG. 5.

That portion of the air/gas mixture which passes between the protrusions 5 is throttled by the passage-way between the top face of the skirt and the bottom face of the cap.

At this level a pilot flame would develop. Seen from the outside, the burner according to the invention therefore has an uninterrupted slit underneath the cap at the level of which the pilot flame would develop which will thus stabilize the main flames from above.

It has been made apparent that the positioning of the protrusions 25 is important. In particular, the burner does not work in a suitable manner when the protrusions are located at the side edge 28 of the slits 23.

It has also been shown that the operation of the burner was substantially improved when the protrusions were positioned towards the inner edge 26 of the peripheral skirt 22. In particular, the burner does not work in a satisfactory manner when the protrusions are located on the outer edge 29 of the peripheral skirt.

As already shown on FIG. 1, the cap 1 comprises on its bottom face 11, a nose-like flange 12 turned towards the head.

The cap slightly projects beyond the head so that the flange 12 is remote from the outlet of the main and pilot flames.

This flange causes a turbulence in the pilot flame. The latter defines a zone of recirculation of the pilot flame with the upper portion of the main flames, thereby stablizing them.

Thus this flange 12 permits the pilot flame located above the main flames to be as effective as a pilot flame at the base of the main flames.

FIG. 4 shows the shape of the main flames when the flow rate of the air/gas mixture is relatively great.

Figure 6:
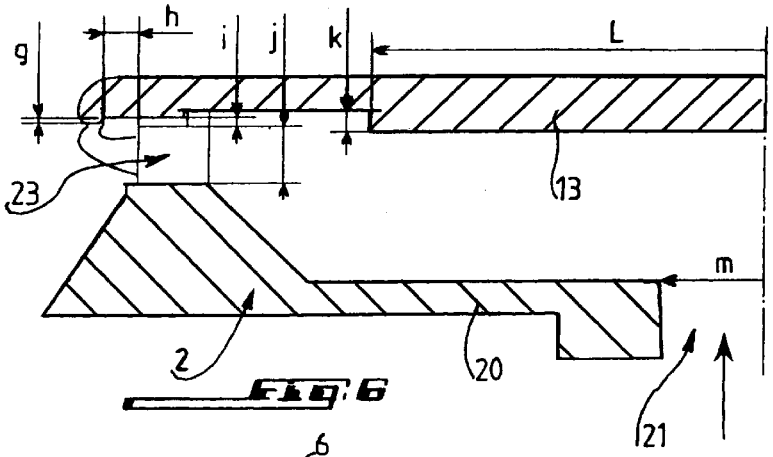
FIG. 6 is a half view in axial section of the burner according to the invention with a main flame corresponding to a reduced flow rate of the air/gas mixture.

FIG. 6 shows the shape of the main flames when the flow rate of the air/gas mixture is reduced. In this case, the main flame would naturally ensconce itself underneath the cap 1 of the burner. Owing to the continuity of the slit underneath the cap of the burner for the pilot flame, the latter provides for the re-ignition of that portion of the main flames which would happen to extinguish or to be quenched, for example, due to a draft.

It was thus possible to ascertain that the burner according to the invention permitted a suitable operation in a broad range of air/gas mixture flow rates. In particular, the operation of the burner is possible in a ratio between the minimum flow rate and the rated flow rate of the air/gas mixture, which is about 1/10.

As already shown on FIG. 1, the cap 1 of the burner also comprises a boss 13 on its inner face 11.

This boss decreases the speed of that portion of air/gas mixture which passes into the space provided between the protrusions and the top face of the skirt and the inner face of the cap, which is shown by the arrows F2 on FIGS. 4 and 5.

This boss substantially improves the stability of the flames with gases having a tendency to be blown off.

In a general manner, it is seen that the passage-way or slit between the top face of the skirt and the cap brings about a better stabilization of the main flames. This is in particular due to the fact that the pilot flame is practically connected to the main flames, thereby permitting use of a burner in a great range of flow rates of the air/gas mixture.

This burner may therefore be more aerated with primary air than the burners which do not comprise such a slit for the pilot flame.

Moreover, the burner according to the invention may operate with a height underneath the grid, i.e., with a height between the cooking plane and the bottom of a container, which is limited.

This burner may, for example, operate with a height underneath the grid between 25 and 30 mm, whereas the conventional burners require a height underneath the grid between 35 and 45 mm.

This reduced height underneath the grid is in particular possible because the burner according to the invention requires less secondary aeration, since the primary aeration may be relatively large.

However to promote the secondary aeration, it is preferable that the slits 23 of the burner head be relatively spaced from each other.

It is, in addition, ascertained that the presence of a pilot flame above the main flames and not at their base would improve the combustion welfare under operating limit conditions of the burner.

Figure 7:
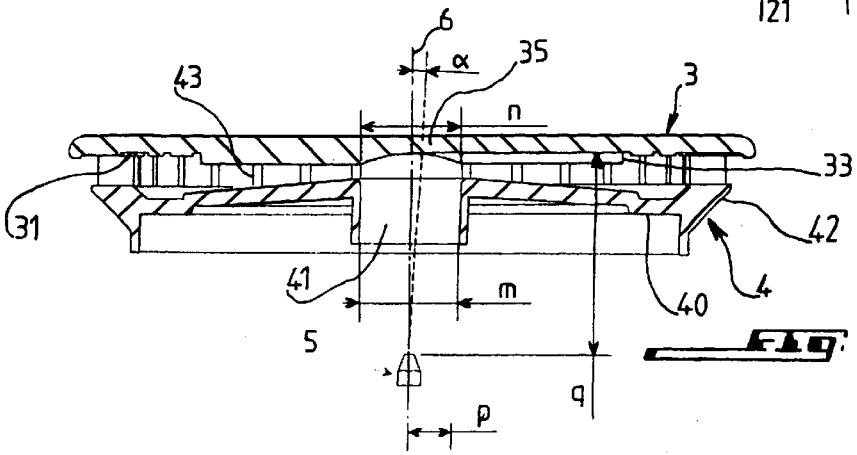
FIG. 7 is a view in axial section of a burner according to the invention intended for a cooker top or hotplate.

Reference should be made now to FIG. 7 which shows a burner according to the invention designed for a cooker top or hotplate.

In this case the space available for the gas injector and the air/gas mixer is reduced with respect to a conventional cooker.

That is why the burner is then conceived in order that the air/gas mixture be provided in the burner itself.

The burner comprises a cap 3 and a head 4.

The base 40 of the head 4 is not entirely flat. Its central portion, which comprises an aperture 41 for the feeding with gas, is slightly raised with respect to the base of the slits 43 and is then sloping towards the skirt 42.

The reference numeral 5 designates the gas injector; this gas is fed to the burner through the aperture 41.

This particular shape of the base 40 forms the air/gas mixture in the space defined between the cap and the base.

It is found that this type of mixer is very sensitive to the precision of the positioning of the injector with respect to the axis 6 of the burner. For example, if the angle $\alpha$ which the injector makes with the axis 6 of the burner is about 1°, this would produce a visible asymmetry of the main flames which is due to local variations of the air/gas ratio in the mixture.

This is why, in the embodiment of the burner shown in FIG. 7, the cap 3 comprises a dome 35 which is formed as a hollow in the boss 33 in the inner face 31 of the cap 3.

This dome has a concavity turned towards the base 40 of the head of the burner. Preferably this dome 35 defines a portion of a spherical surface of which the center is located at the level of the injector 5 and of which the radius corresponds to the distance between the dome and the injector.

The presence of this dome 35 provides correct operation of the burner even if the angle $\alpha$ is about 3° and if the axis of the injector is offset by about 2 mm with respect to the axis 6 of the burner (reference character p).

This dome 35 therefore improves the flexibility of the mounting of the burner according to the invention.

Exemplary operating dimensions for a burner according to the invention with a rated power of 3,500 W are now provided.

These dimensions are shown in the table hereinafter. The dimensions mentioned in the table are indicated in FIGS. 3, 6 and 7 to facilitate the understanding.

| Definition of the dimension | Dimension | Rated value in millimeters | Admissible variation |
|---|---|---|---|
| Width of the slits | a | 1.8 | <2.2 |
| Distance between the slits | b | 5 a | >3 a |
| Thickness between two adjacent slits | c | | |
| Width of the protrusions | d | ⅓ c | <1/2 c |
| Depth of the main slits | e | 6 | >2.5 a |
| Depth of the protrusions | f | ⅓ e | <0.5 e |
| Height of the nose | g | ⅔ i | <½ i |
| Distance between nose and outlet of the flames | h | 3 | 2 to 5 |
| Height of the pilot slit | i | 0.8 | 0.6 to 1 |
| Height of the main slits | j | 5 | |
| Height of the boss | k | 2 | >1.5 |
| Diameter of the boss | L | 3.5 m | 1.5 to 4 m |
| Diameter of the outlet of the aperture | m | | |
| Diameter of the dome | n | | >m |
| Off-center of the injector | p | 0 | <2 |
| Distance between nose of the injector and dome | q | | |
| Radius of the dome | r | = q | |
| Offset angle of the injector | $\alpha$ | 0° | <3° |

Although the invention has been described in connection with particular embodiments, it is not at all limited to these embodiments and it comprises all the technical equivalents of the means described as well as their combinations if the latter are within the scope of the invention.

In particular in the examples described, a protrusion is systematically provided between two slits for the main flames. A burner according to the invention may comprise a more limited number of protrusions where the protrusions provided permit effective generation of a pilot flame, distinct from the main flame.

Moreover the embodiment of the cap of the burner shown on FIG. 7, comprising a dome on the inner face of the cap, could be used with any burner head which does not necessarily comprise protrusions between the slits for the main flames.

What is claimed is:

1. A gas burner for a cooking apparatus comprising a head and a cap laid on the head, the head comprising a base having an aperture for feeding an air/gas mixture and a peripheral skirt, the skirt having slits substantially perpendicular to the base and extending through the skirt substantially parallel to the base, and a supporting face divided into supporting face portions between each adjacent pair of slits, the supporting face portions having respective inner halves and respective outer halves, the outer halves being closer to the aperture than the outer halves and a plurality of protrusions on the supporting face portions extending generally perpendicular to the base, each protrusion having a width measured between the pair of adjacent slits that is smaller than a distance between the pair of adjacent slits, being located substantially equidistant from the pair of adjacent slits, and being located within the inner halves of the supporting face portions, the protrusions contacting and supporting the cap, thereby providing a space between the cap and the head in which a portion of the air/gas mixture is throttled.

2. The gas burner according to claim 1, wherein the width of each of the protrusions is smaller than one half of the distance between the pair of adjacent slits.

3. The gas burner according to claim 1, wherein the protrusions and the slits have respective depths measured along a direction generally parallel to the base, and the depth of the protrusions is smaller than one half of the depth of the slits.

4. The gas burner according to claim 1, wherein the skirt has an internal edge, and each protrusion has one side located in a plane of the internal edge of the skirt.

5. The gas burner according to claim 1, wherein the cap projects beyond the protrusions and comprises a nose-like flange for positioning of the cap on the head.

6. The gas burner according to claim 1, wherein the cap has an inner face, and comprises a boss substantially centered on the inner face.

7. The gas burner according to claim 1, wherein the cap includes, on an inner face, opposite the aperture, a shape for deflection of the air/gas mixture introduced from an injector through the aperture, the shape having a concavity.

8. The gas burner according to claim 7, wherein the concavity includes a portion of a spherical surface having a center located at the injector.

9. The gas burner according to claim 1, wherein the head and the cap have a substantially circular or oval shape.

10. The burner according to claim 1, wherein the head is molded aluminum.

11. The gas burner according to claim 1, wherein the cap is cast iron or steel.

* * * * *